United States Patent [19]

Saby

[11] 4,193,531

[45] Mar. 18, 1980

[54] PACKING FOR EGGS

[76] Inventor: Marc Saby, Villa Maeva, Domicile les Parcs de St. Tropez, France

[21] Appl. No.: 883,097

[22] Filed: Mar. 3, 1978

[30] Foreign Application Priority Data

Mar. 8, 1977 [FR] France ..... 77 07731

[51] Int. Cl.[2] ..... B65D 45/00

[52] U.S. Cl. ..... 229/2.5 EC; 206/583; 206/586; 229/45 EC

[58] Field of Search ..... 206/583, 586, 591; 229/2.5 EC, 45 EC

[56] References Cited

U.S. PATENT DOCUMENTS

| | | | |
|---|---|---|---|
| 2,423,756 | 7/1947 | Chaplin | 229/2.5 EC |
| 3,171,562 | 3/1965 | Weiss | 229/2.5 |
| 3,234,030 | 2/1966 | Knirim | 229/2.5 EC |
| 3,356,277 | 12/1967 | Hohnjec | 229/2.5 |
| 3,568,914 | 3/1971 | Ahlmeyer | 229/2.5 EC |
| 3,662,943 | 5/1972 | Donaldson | 229/2.5 EC |
| 3,674,168 | 7/1972 | Padovani | 229/2.5 |

FOREIGN PATENT DOCUMENTS

| | | | |
|---|---|---|---|
| 485038 | 1/1975 | U.S.S.R. | 206/591 |

*Primary Examiner*—Joseph Man-Fu Moy
*Attorney, Agent, or Firm*—William Drucker

[57] ABSTRACT

A packing device for the transportation of eggs, intended to position them stabilize them, preserve them, and protect them against shocks and pollution, while at the same time aerating them and leaving them visible, has at each egg position two dished shaped receptacles, one upper and one lower, which are provided with flexible flaps in the shape of truncated prisms, and two rings on which are secured flexible flaps, together with spaced webs positioned perpendicularly to the plane of the egg.

4 Claims, 2 Drawing Figures

PACKING FOR EGGS

BACKGROUND OF THE INVENTION

The invention relates to a packing device for the transportation of eggs and their presentation at the point of sale.

It is intended to permit the positioning, the stabilisation and the protection of eggs and fragile articles against shocks and pollution.

In the known devices, the eggs were either packed in newspaper, or in boxes of compressed paper or of synthetic resin or the like, which prevented the eggs from breathing and hid them from view. Furthermore the egg remained in contact with the material of the packing which often risked polluting them without protecting them perfectly from shocks.

OBJECTS OF THE INVENTION

An object of the invention is to eliminate these inconveniences and permit not only to protect the egg from shocks, but also to ventilate it to the maximum in order to facilitate its conservation. Furthermore the egg is visible in its totality, protected from contamination which might arise during packing and offers a large surface to carry visibly the mark of the producer.

SUMMARY OF THE INVENTION

According to the invention there is provided a packing for the transportation of eggs, comprising a base having a plurality of integrally formed receptacles, a lid having the same number of integrally formed receptacles and positioned to coincide with those in the base, a first annular series of radially inwardly extending flexible filaments disposed within each of said receptacles in the base, a second annular series of radially inwardly extending flexible filaments disposed within each of said base receptacles and located above said first series, a plurality of upwardly extending filamental support elements within the receptacles in the base, and a plurality of downwardly extending filamental elements fixed to the tops of the insides of the receptacles in the lid, whereby the two annular series of flexible filaments whilst permitting entry of the eggs restrict movement of the eggs in the horizontal direction and said upwardly and downwardly extending filaments restrict movement in the vertical direction, said packing being stackable with like packings when in the open position.

BRIEF DESCRIPTION OF DRAWINGS

In the accompanying drawings given by way of non-limiting example of one of the forms of construction of the object of the invention.

DESCRIPTION OF PREFERRED EMBODIMENT

Figure 1:
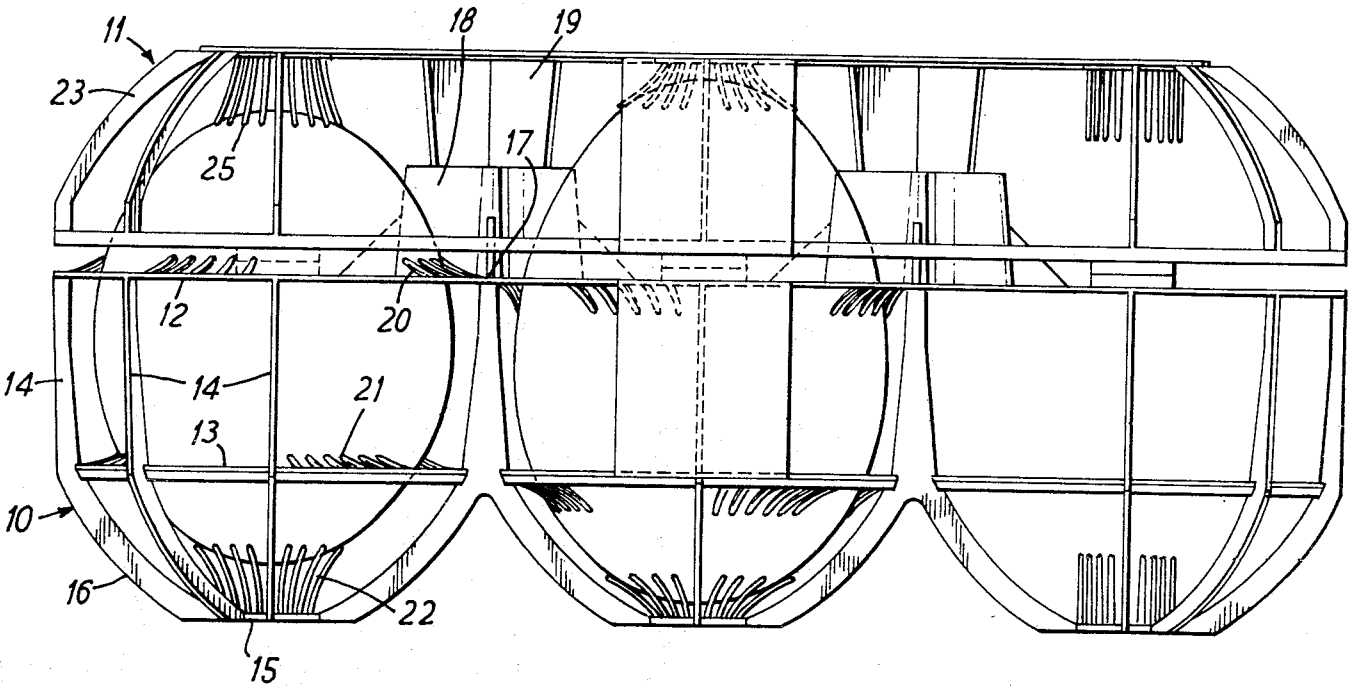
FIG. 1 is an elevational view showing the constructional detail of the packing.
Figure 2:
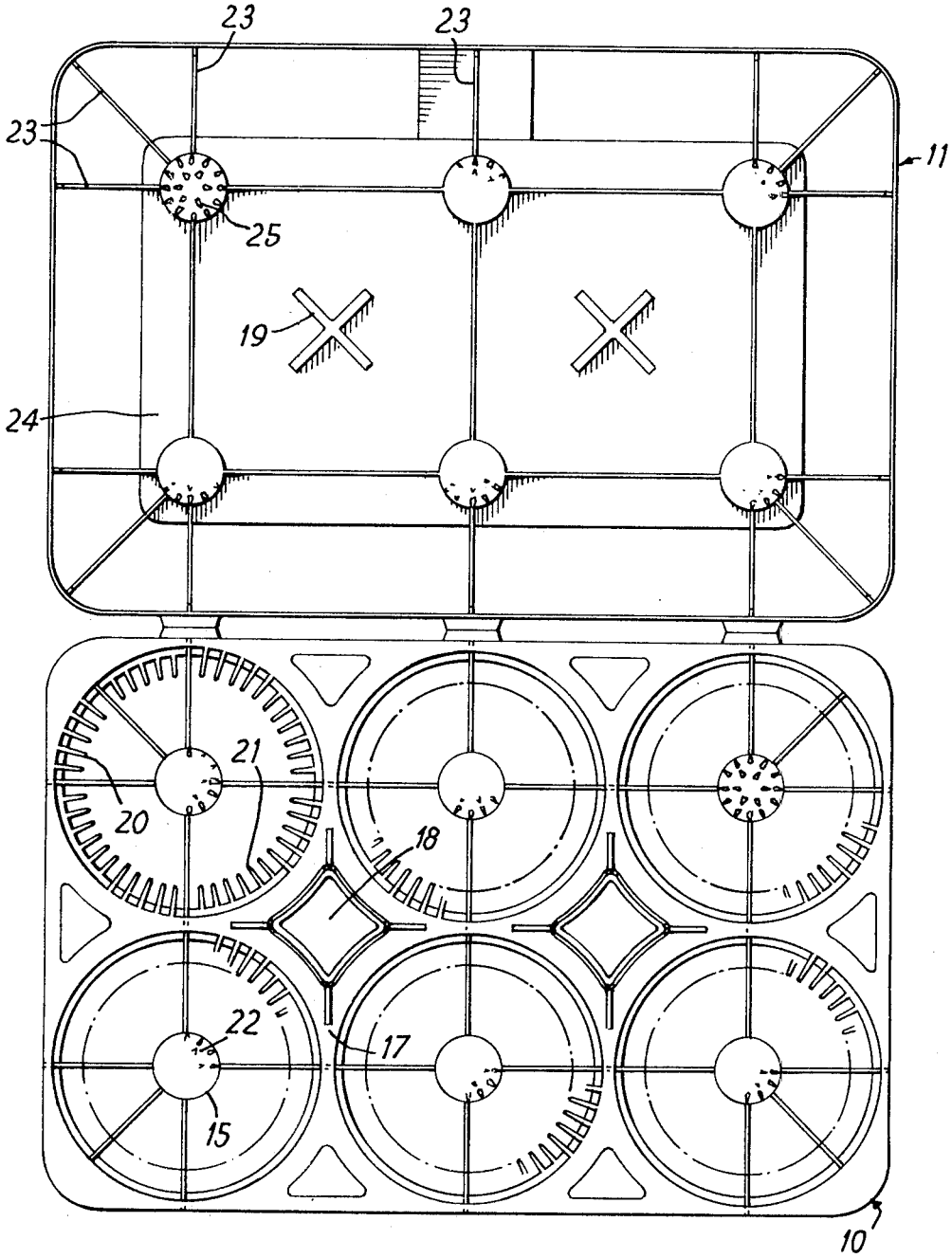
FIG. 2 is a view in plan of the whole of the packing with the lid open.

The packing comprises a base 10 and a lid 11 capable of supporting and packing six eggs. The base 10 has six receptacles each defined by a pair of vertically spaced rings 12, 13 interconnected by substantially vertical ribs 14 some of which are common to adjacent receptacles. The lower ring 13 is connected to a central disc 15 by means of curved ribs 16.

Rising from an interconnecting portion 17 and integrally formed therewith are platforms 18 which serve to support posts 19 formed in the lid 11 as described hereinafter. Each ring 12, 13 is provided with a ring of flexible radially inwardly extending elements 20, 21, individual elements being in the form of truncated prisms or cones. Projecting upwardly from the central disc 15 are flexible filamental supports 22, in the form of truncated prisms or elongated cones, the ends of which lie in a substantially spherical or dish-shape conforming to the surface of the end of an egg.

The lid 11 likewise has six frame-like receptacles positioned to coincide with the receptacles of the base 10. The lid is of less depth than the base. The lid is formed with webs and ribs 23 and a flat top surface 24 from the underside of which depend groups of flexible filaments 25 extending downwardly and have, as in the same manner as supports 22, their lower ends lying in a dish shape. Also depending from the underside of the top surface 24 are support posts 19 which come to rest on the platforms 18 when the packing 11 is closed.

On insertion of the eggs into the packing the eggs receive a braking effect by their engagement with the flexible elements 20, 21. The eggs come to rest on the filamental supports 22. On placement of the lid on the base the eggs are secured vertically between the filaments 22 and 25. Movement of the eggs in the horizontal direction is restricted by the two rings of flexible elements 20, 21. By their flexibility these elements 20, 21, 22 and 25 provide a shock-absorbing function to safeguard the eggs against shocks exerted during packing or transportation. In order to permit the stacking of the empty packings, the elements 20 on the ring 12 are offset in plan with respect to the elements 21 on the ring 13 in order to avoid the superpositioning of the elements which would otherwise prevent them being stacked.

The ribs 14, 16 and 23 are suitably spaced from the eggs to ensure the total ventilation of the eggs.

The packing enables the egg to be visible in its totality for ease of inspection.

In spite of the possible use of materials of foodstuff quality, the packing has been designed in order that the egg shall have only a minimum of contact with the walls of the packing in such a manner as to avoid contamination, at the same time permitting circulation of air.

The egg is suspended between the upper and lower elements 23, 25, and supported by the horizontal elements 20, 21 in such a manner that the contacts between the eggs and the packing are reduced to a minimum.

The top of the box 24 is formed by a perfectly plane surface without break of continuity in such a manner as to be able to receive printed matter.

I claim:

1. A packing for the transportation of eggs, comprising:

(a) a base having a plurality of integrally formed receptacles, (b) a lid having the same number of integrally formed receptacles and positioned to coincide with those in the base, (c) a first annular series of radially inwardly extending flexible filaments disposed within each of said receptacles in the base, (d) a second annular series of radially inwardly extending flexible filaments disposed within each of said base receptacles and located above said first series, (e) a plurality of upwardly extending filamental support elements within the receptacles in the base, and (f) a plurality of downwardly extending filamental elements fixed to the tops of the insides of the receptacles in the lid, whereby the two annular series of flexible filaments whilst permitting entry of the eggs restrict movement of the eggs in the horizontal direction and said upwardly and downwardly extending filaments restrict movement in the vertical direction, said packing being stackable with like packings when in the open position, wherein the filaments of the first annular series are angularly offset from those of the second series in plan thereby to facilitate stacking of empty packings.

2. A packing according to claim 1, wherein the ends of the filaments extending downwardly are located in a dishshape and likewise the ends of the filaments extending upwardly are located in a dish-shape.

3. A packer according to claim 1, wherein said first and second annular series of filaments are supported on concentric rings arranged one above the other.

4. A packing according to claim 1, wherein there are provided ribs and webs formed integrally with said rings to form an open frame-like structure.

* * * * *